US012324527B2

(12) United States Patent
Swears

(10) Patent No.: US 12,324,527 B2
(45) Date of Patent: Jun. 10, 2025

(54) MULTI-WHEEL ROTATIONAL DISPLAY ASSEMBLY

(71) Applicant: Eran Swears, Saratoga Springs, NY (US)

(72) Inventor: Eran Swears, Saratoga Springs, NY (US)

( * ) Notice: Subject to any disclaimer, the term of this patent is extended or adjusted under 35 U.S.C. 154(b) by 0 days.

(21) Appl. No.: 18/588,155

(22) Filed: Feb. 27, 2024

(65) Prior Publication Data

US 2024/0315467 A1 Sep. 26, 2024

Related U.S. Application Data

(63) Continuation-in-part of application No. 18/125,458, filed on Mar. 23, 2023, now Pat. No. 11,944,193.

(51) Int. Cl.
*A47F 5/00* (2006.01)
*A47F 7/00* (2006.01)
*A47F 7/28* (2006.01)

(52) U.S. Cl.
CPC ..... *A47F 5/0037* (2013.01); *A47F 5/0087* (2013.01); *A47F 7/0071* (2013.01); *A47F 7/28* (2013.01)

(58) Field of Classification Search
CPC ..... A47B 49/00; A47B 49/002; A47B 49/004; A47B 49/008; A47F 3/06; A47F 3/10; A47F 3/11; A47F 5/02; A47F 5/025; A47F 5/03; A47F 5/0037; A47F 5/0087; A47F 7/0071; A47F 7/28
See application file for complete search history.

(56) References Cited

U.S. PATENT DOCUMENTS 729,642 A * 6/1903 Nash ..... A47B 11/00 211/121
1,208,457 A * 12/1916 Bellville ..... A47B 11/00 108/94
1,254,983 A * 1/1918 Chadwick ..... A47F 3/08 108/22
1,689,865 A * 10/1928 Davis ..... A63B 71/0672 40/598
2,512,465 A * 6/1950 Moorehouse ..... A47F 3/11 40/473

(Continued)

*Primary Examiner* — Stanton L Krycinski
(74) *Attorney, Agent, or Firm* — Dale J. Ream

(57) ABSTRACT

The multi-wheel display assembly includes a lower display portion having a circular configuration in a horizontal plane and an upper display portion having a circular configuration in a horizontal plane that is displaced upwardly from the lower display portion by a plurality of support rods, each display portion including a plurality of planetary and orbital gears each having a peripheral edge and teeth appropriately engaged for rotation of the gear systems. Specifically, the display assembly includes a gearing system with a central drive gear, multiple planetary-gears, and a third layer of orbiting gears that each have a horizontal side wall for holding a display article such as a mug or food item and which remains level even as respective gears revolve. The orbiting gears and the planetary gears are radially arranged along concentric circumferential paths and connected to the central drive gear through complementary rotational movements and complementary gear teeth.

17 Claims, 19 Drawing Sheets

(56) References Cited

U.S. PATENT DOCUMENTS

| | | | | | |
|---|---|---|---|---|---|
| 3,506,260 | A * | 4/1970 | Johnson | A63G 1/26 | 472/29 |
| 3,897,063 | A * | 7/1975 | Lehwalder | A63F 3/00895 | 273/284 |
| 4,179,168 | A * | 12/1979 | Isaac | A47F 3/10 | 312/305 |
| 5,109,989 | A * | 5/1992 | Kremmin | A47F 5/025 | 211/163 |
| 7,665,244 | B2 * | 2/2010 | Jesness, III | A01G 27/006 | 47/66.6 |
| 8,272,519 | B1 * | 9/2012 | Rekhels | A47F 5/02 | 211/163 |

* cited by examiner

MULTI-WHEEL ROTATIONAL DISPLAY ASSEMBLY

REFERENCE TO RELATED APPLICATIONS

This application is a continuation-in-part and claims the benefit of U.S. patent application Ser. No. 18/125,458|filed Mar. 23, 2023 entitled MULTI-WHEEL ROTATIONAL SHELVING ASSEMBLY which claims the benefit of Provisional patent application No. 63/425,479 filed Nov. 15, 2022 and titled GEAR-DRIVEN SHELVING WHEEL, all of which are incorporated herein in their entireties.

BACKGROUND OF THE INVENTION

This invention relates generally to display systems and, more particularly, to a multi-tier framework having a plurality of rotating wheels that enable easy access to displayed articles by spinning a system of gears.

A first embodiment of the present invention involves a plurality of shelves. A shelf is a flat horizontal surface used for display and storage of, for example, books, picture frames, kitchen items, vases, and the like. Shelving is most often constructed as multiple fixed layers of horizontal support services, i.e., multiple levels of planar boards or platforms mounted to a framework as multiple parallel support services. In many cases, the lower shelves may be accessible to a person in a sitting or standing position whereas the higher shelves may require a user to climb up a stepstool, stepladder, or traditional ladder in order to reach articles stored on the higher shelves. Obviously, retrieving items from upper shelves may be inconvenient and even dangerous. To be sure, traditional shelving is fixedly mounted and arranged at multiple parallel horizontal positions that are difficult to access without auxiliary equipment.

Therefore, it would be desirable to have a multi-wheel shelving assembly that is conveniently rotatable to bring a particular shelf to a level that is accessible to a seated or standing user without the need for a height augmenting device such as a stepladder. Further, it would be desirable to have a multi-wheel shelving assembly that utilizes a multi-wheel gear train to which a plurality of shelves is directly attached and which are configured such that the plurality of shelves remain perfectly level, i.e., parallel to a floor surface, even as they are rotated circularly to a desired access level.

In another embodiment, it would be desirable to have a multi-wheel display assembly that is rotatable to display articles such as cups, mugs, cupcakes, figurines, and the like where each displayed article is available and selectable when the assembly is rotated in a horizontal plane.

SUMMARY OF THE INVENTION

In one embodiment, the present invention is directed to a multi-wheel shelving assembly—a gearing system having a central drive gear, multiple planetary-gears, and a third layer of orbiting gears that each have a horizontal shelf attached. The shelf-orbiting gears and the planetary gears are radially arranged along concentric circumferential paths and connected to the central drive gear through complementary rotational movements and complementary gear teeth. The multi-wheel shelving assembly includes a framework having a faceplate coupled to the drive gear, an outer peripheral frame member pivotally coupled to the outer layer of orbiting gears and having spokes connecting the peripheral outer frame member and faceplate and to which the plurality of planetary gears is pivotally attached. The peripheral outer frame member and, therefore, the plurality of orbiting gears are rotatably coupled to a hub whereas the drive gear is fixed in space. Of critical importance, a shelf is coupled to a front side edge of each orbiting gear and to the drive gear and is configured to remain level or parallel to a floor surface at all times as the orbiting gears orbit the drive gear.

In another embodiment, a multi-wheel rotational display assembly includes a base member having an unmovable configuration and includes a Lazy-Susan bearing and a flange. The assembly includes a shaft having a first end fixedly coupled to the flange, the shaft extending upwardly from the flange and having a linear configuration defining an imaginary longitudinal axis. The assembly includes a lower display portion having a generally circular and planar configuration that defines a horizontal plane and that includes opposed upper and lower surfaces and a peripheral edge that includes a plurality of teeth, the lower display portion being rotatably coupled atop the Lazy-Susan bearing. A lower portion drive wheel is fixedly coupled to the shaft and positioned in the horizontal plane of the lower display portion so as to be unrotatable, the lower portion drive wheel including a peripheral edge having a circular configuration and a first predetermined number of teeth.

In another aspect, an orbiting wheel assembly includes a plurality of orbiting wheels each being spaced apart from an adjacent orbiting wheel and displaced a predetermined distance from the peripheral edge of the drive wheel. The plurality of orbiting wheels includes a peripheral edge having a second predetermined number of teeth and having a circular configuration.

In another aspect, the display assembly includes a planetary wheel assembly having a plurality of planetary wheels, each being displaced from an adjacent planetary wheel and being situated intermediate a corresponding orbiting wheel and the lower portion drive wheel. Each planetary wheel includes a peripheral edge having a third predetermined number of teeth and having a circular configuration. In operation, respective teeth of the planetary wheel are operatively and simultaneously engaged with a respective tooth of the lower portion drive wheel and with a respective tooth of a respective orbiting wheel such that displayed items maintain a same orientation in space despite engagement and rotation of the gears described above.

Therefore, a general object of this invention is to provide a multi-wheel shelving assembly, in which a plurality of shelves is rotationally movable to a desired access height using a multi-wheel gear train.

Another object of this invention is to provide a multi-wheel shelving assembly, as aforesaid, in which the multi-wheel gear train is configured such that operation thereof maintains each shelf in a level orientation, i.e., parallel to a ground or floor surface.

Still another object of this invention is to provide a multi-wheel shelving assembly, as aforesaid, in which the plurality of shelves is interconnected such that they move in unison when the plurality of gears is rotated by actuation of a circular frame member.

A further object of this invention is to provide a multi-wheel display assembly in which displayed articles, such as mugs, cupcakes, or the like maintain a singular directional orientation despite the engagement of multiple gear class wheel assembly.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
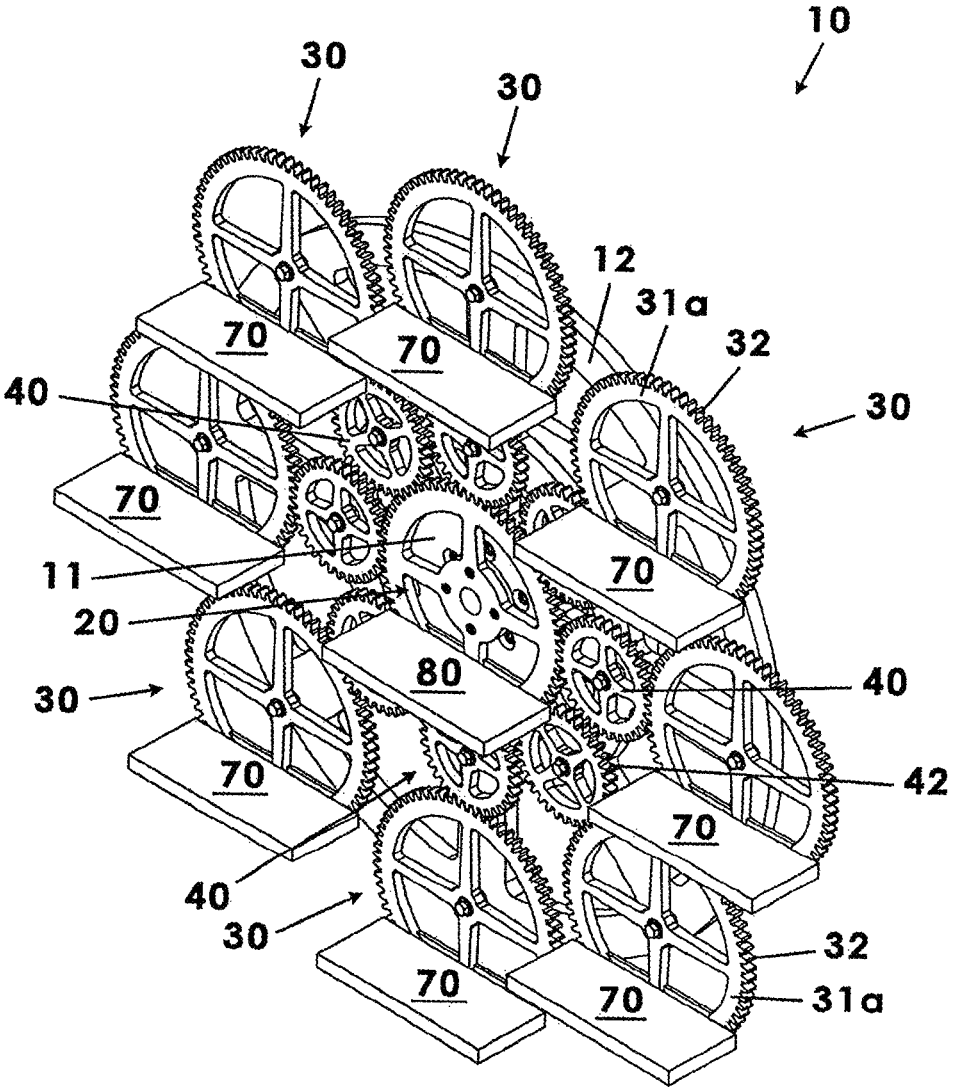
FIG. 1 is a perspective view of the multi-wheel rotational shelving assembly according to a preferred embodiment of the present invention.

A multi-wheel rotational shelving assembly according to a preferred embodiment of the present invention will now be described with reference to the accompanying drawings. The multi-wheel rotational assembly 10 includes a drive wheel 20, an orbiting wheel assembly, a planetary wheel assembly positioned intermediate the drive wheel and orbiting wheel assemblies, respectively, and a plurality of shelves 70 coupled to the frontside edges of respective orbiting wheels, respectively.

The multi-wheel rotational shelving assembly 10 has a framework to which most or all of the components to be described in this application are directly or indirectly attached and which provides the unique functionality of the invention. More particularly, the framework includes an interface plate 11, a peripheral frame member 12, and a plurality of spokes 13 extending between the interface plate 11 and peripheral frame member 12. For context and clarification, the interface plate 11 may have a generally circular and planar configuration similar in appearance to a gear but with no teeth. The interface plate 11 will be described in greater detail later. In addition, the peripheral frame member 12 may have a circular or ring-shaped configuration, the peripheral frame member 12 defining a diameter that is larger than a diameter of the interface plate 11. Preferably, however, the interface plate 11 and peripheral frame member 12 are situated concentrically to one another and with the peripheral frame member 12 being radially displaced from the interface plate 11. In other words, each discrete point on the peripheral frame member 12 is equally displaced from a peripheral edge of the interface plate 11.

Explained geometrically for greater clarity, the peripheral frame member 12 defines an outer circumference of an imaginary circle and the interface plate 11, being displaced inwardly from the peripheral frame member 12, may be situated radially about a center point of the circle. Further, the hypothetical geometric circle defined by the peripheral frame member 12 defines an intermediate circumference situated between the outer circumference defined by the peripheral frame member and the center point, the intermediate circumference defining an imaginary circle that is concentric to that of the outer circumference and the center point. As will be discussed further in greater detail, the center point, intermediate circumference, and outer circumference will describe the configuration and orientation of the drive wheel 20, the orbiting wheel assembly 30, and the planetary wheel assembly 40.

Figure 6:
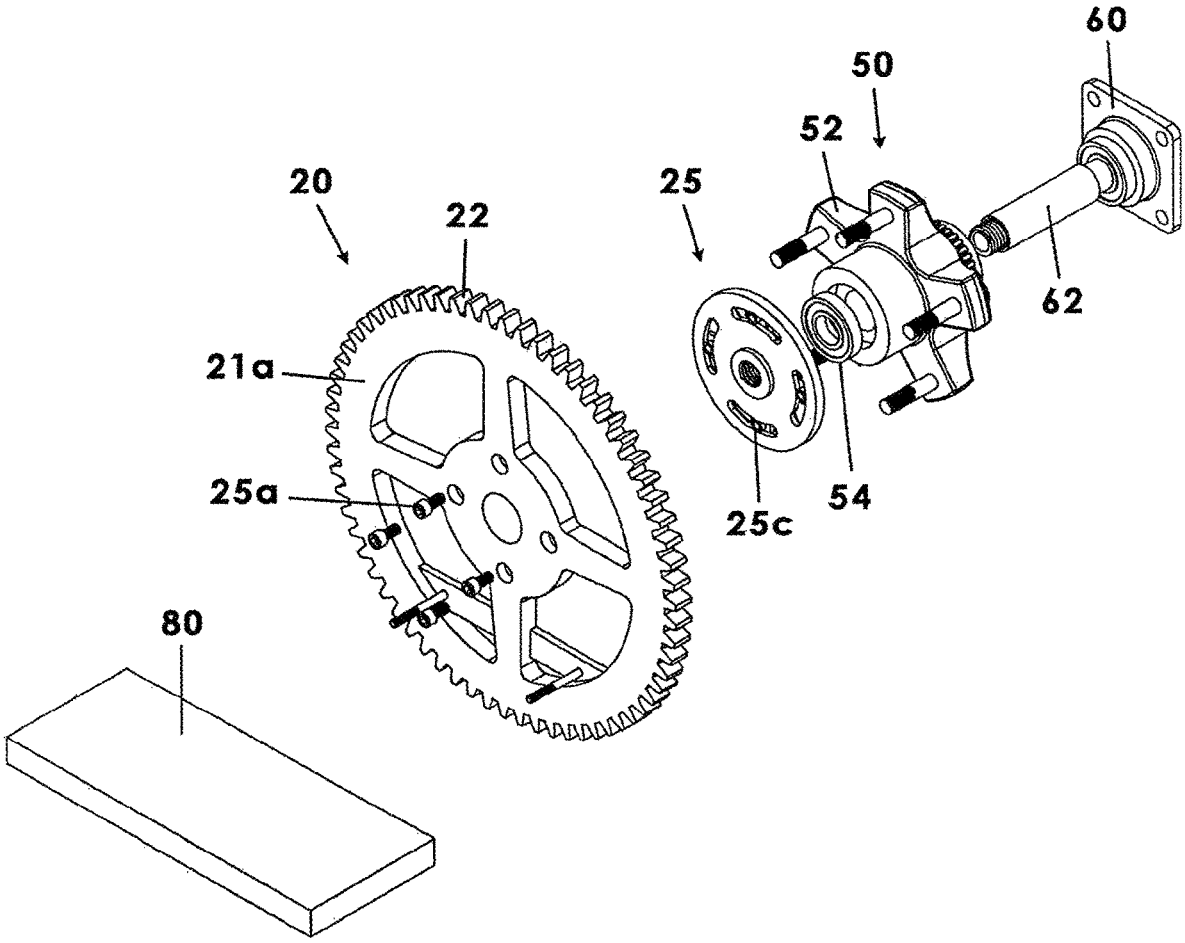
FIG. 6 is an exploded view of the drive gear illustrated in FIG. 5*b;*

Preferably, the multi-wheel rotational shelving assembly 10 will be fixedly mounted to a wall structure, such as a residence, office, entertainment or commercial facility. Accordingly, the multi-wheel rotational shelving assembly 10 may include a mounting plate 60 that is configured for stable and unmovable attachment to a wall structure such as with bolts or similar fasteners (FIG. 6). Also of critical importance, the mounting plate 60 may include a shaft 62 having an elongated and tubular configuration, the shaft 62 having a fixed construction that does not rotate and that extends axially through a central bore 51 defined by the hub 50, interface plate 11, and drive wheel 20 (FIG. 6). It will be understood that the shaft 62 provides a fixed structure to which the drive wheel 20 is fixedly attached and is prevented from rotation whereas the hub 50 is rotatably mounted to the shaft 62 via bearings 54 so as to be rotatable. The specific structure of the hub 50 will be described immediately below.

The multi-wheel rotational shelving assembly 10 includes a hub 50. The hub 50 is specifically configured to enable other components to rotate, i.e., to enable the shelves to be rotated to accessible positions as may be determined by a user. The hub 50 defines a central bore 51 through which the shaft 62 extends, the hub 50 being mounted to the shaft 62 with bearings 54 such that the hub 50 is rotatable about a longitudinal axis defined by the shaft 62. (A bearing ring and bearing compression sleeve are shown in FIG. 7*c* and both labeled 54).

Figure 4A:
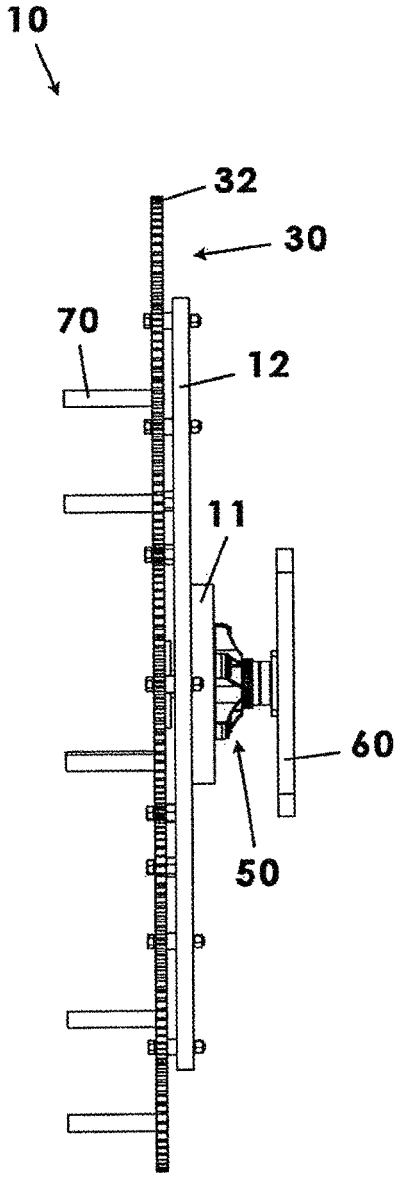
FIG. 4*a* is a side view of the multi-wheel rotational shelving assembly as in FIG. 1.
Figure 4B:
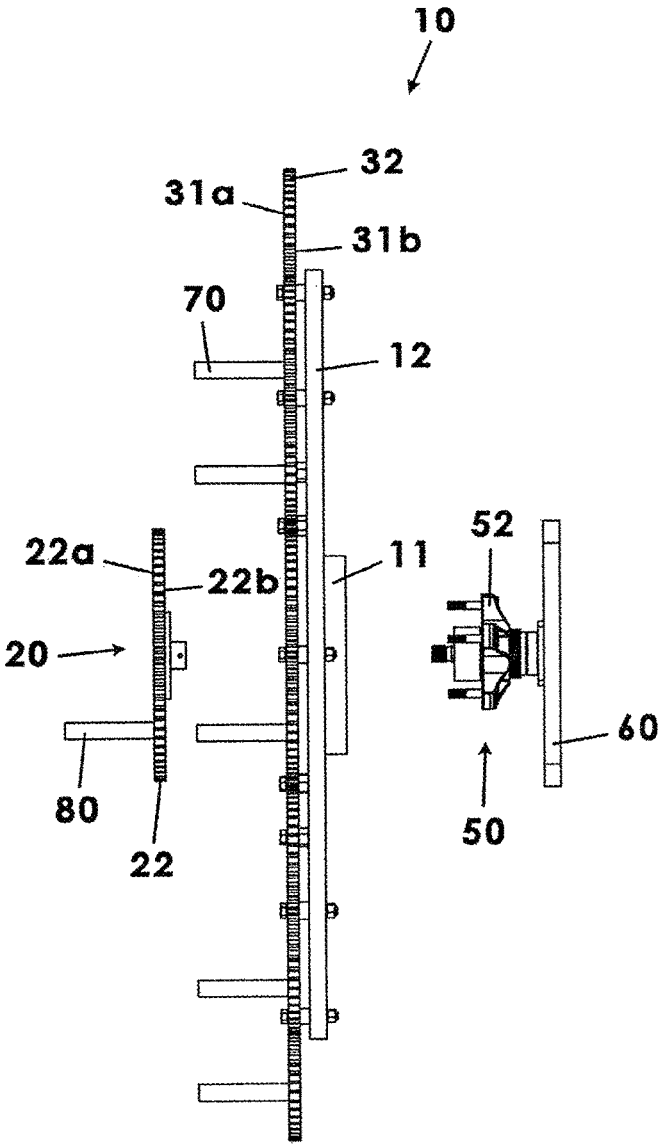
FIG. 4*b* is an exploded view of the multi-wheel rotational shelving assembly as in FIG. 4*a;*
Figure 7A:
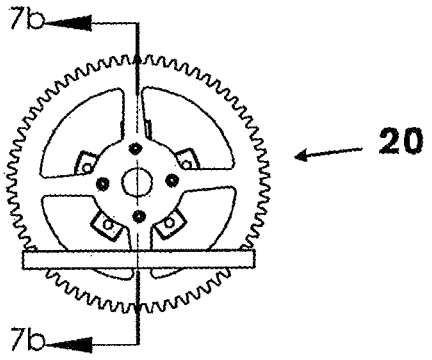
FIG. 7*a* is a front view of the drive gear as in FIG. 6.
Figure 7B:
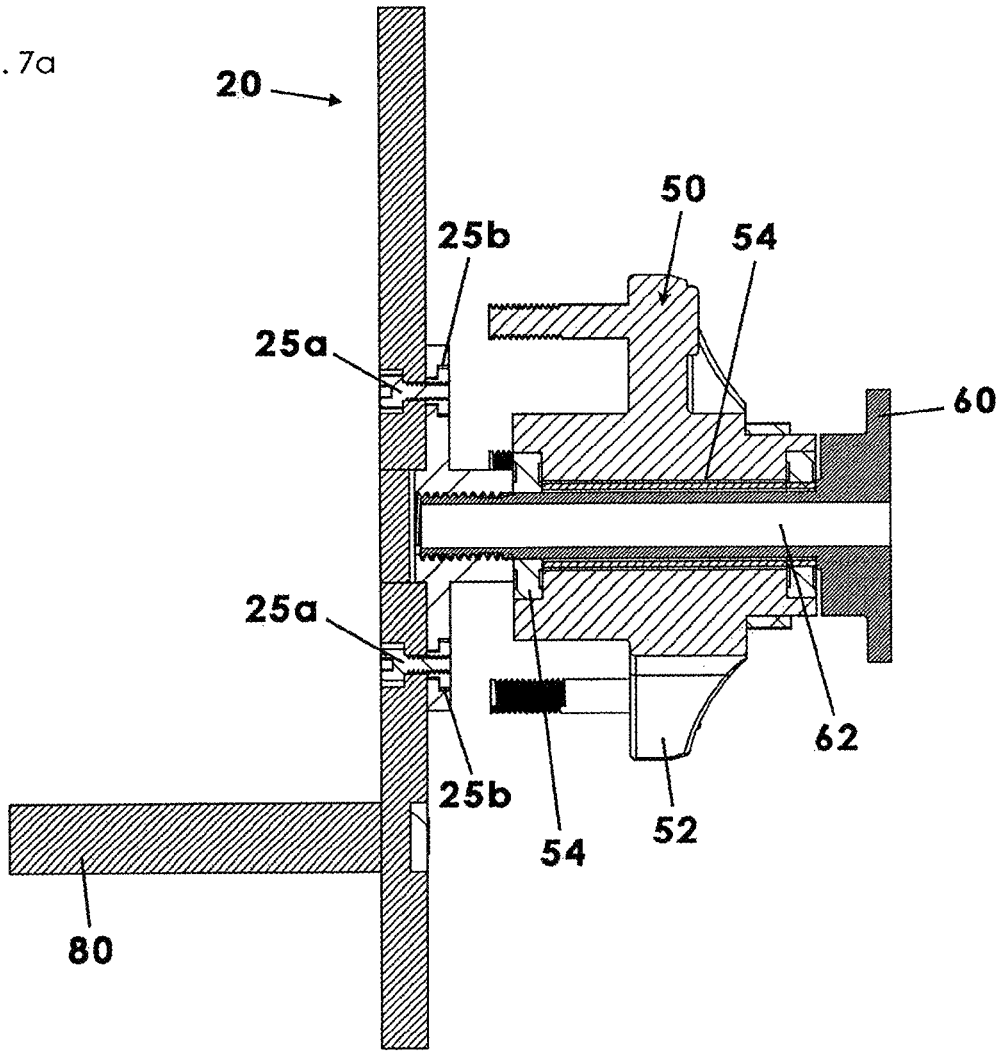
FIG. 7*b* is a sectional view taken along line 7*b*-7*b* of FIG. 7*a;*

Further, the hub 50 includes a plurality of hub arms 52, each arm including a bolt 53 or similar fastener extending forwardly (FIG. 7). In the environment as illustrated, the hub 50 includes 5 hub arms 52 and, therefore, five bolts. Preferably, all of the bolts are fixedly coupled to the interface plate 11, such as with complementary threaded configurations, nuts, or other complementary fasteners as is illustrated by comparing FIG. 4*b* and then FIG. 4*a*. This fixed and complementary attachment can be seen in FIGS. 1 and 2 as well. It can be seen, therefore, that the hub 50 is rotatably movable, the hub is fixedly coupled to the interface plate 11 which is also rotatable, and the interface plate is fixedly coupled to the peripheral frame member 12 which is also rotatable. Accordingly, the hub 50, interface plate 11, peripheral frame member 12, and any other wheels (a.k.a. gears) and that are coupled to the peripheral frame member 12 are rotated in unison as will be further described below. In use, the configuration of the hub 50 enables the peripheral frame member 12 to rotate or "orbit" whilst the drive wheel 20 remains fixed and unable to rotate.

More particularly, the multi-wheel rotational shelving assembly 10 includes a pair of gear assemblies that are configured to move rotationally about the fixed drive wheel 20 so as to move a selected shelf into a lower or more accessible position. More particularly, the multi-wheel rotational shelving assembly 10 includes a drive wheel 20 surrounded by a planetary wheel assembly 40 which is surrounded by an orbiting wheel assembly 30. It is understood that each "wheel" referenced below is, in the preferred embodiment, a "gear" having teeth and being pivotally mounted so as to be rotatable unless specifically described otherwise.

Figure 8A:
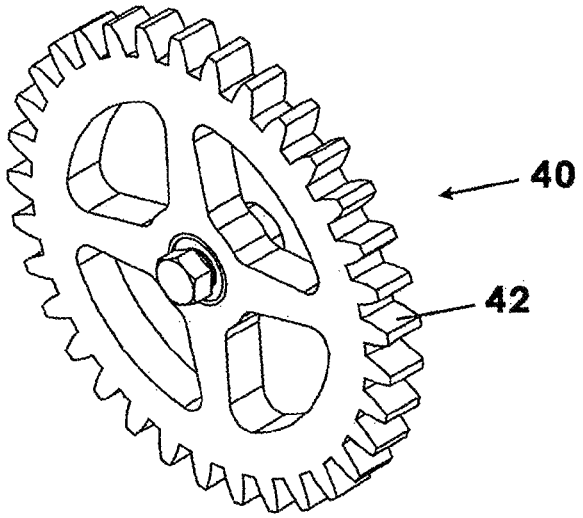
FIG. 8*a* is a front view of the drive gear as in FIG. 6.
Figure 8B:
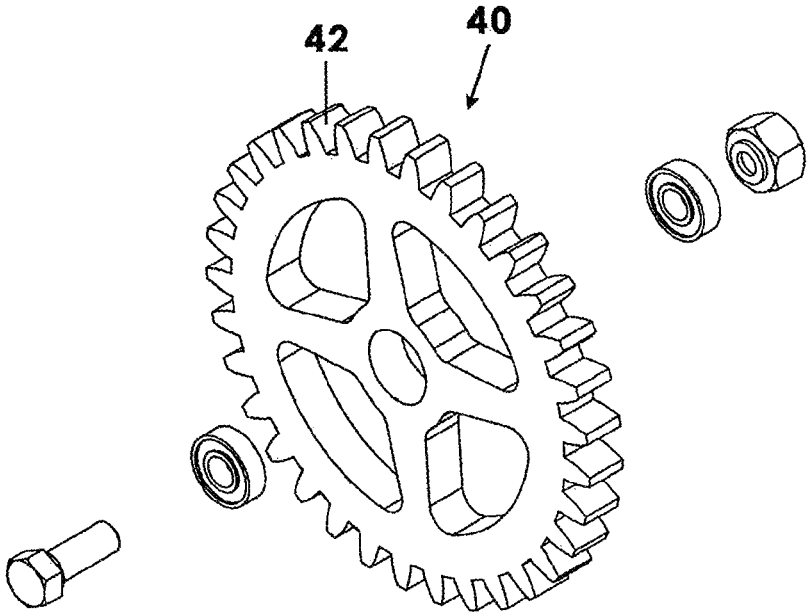
FIG. 8*b* is a sectional view taken along line 8*b*-8*b* of FIG. 8*a;*
Figure 9A:
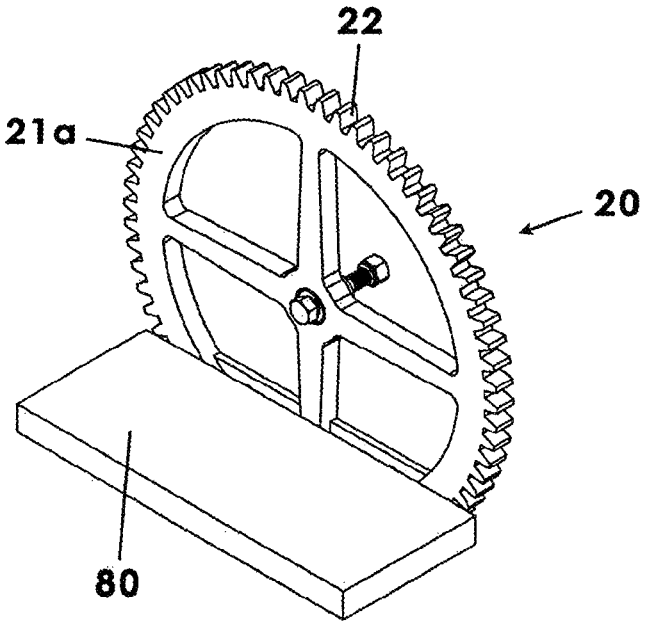
FIG. 9*a* is a perspective view of a planetary gear removed from the multi-wheel assembly as in FIG. 1.
Figure 9B:
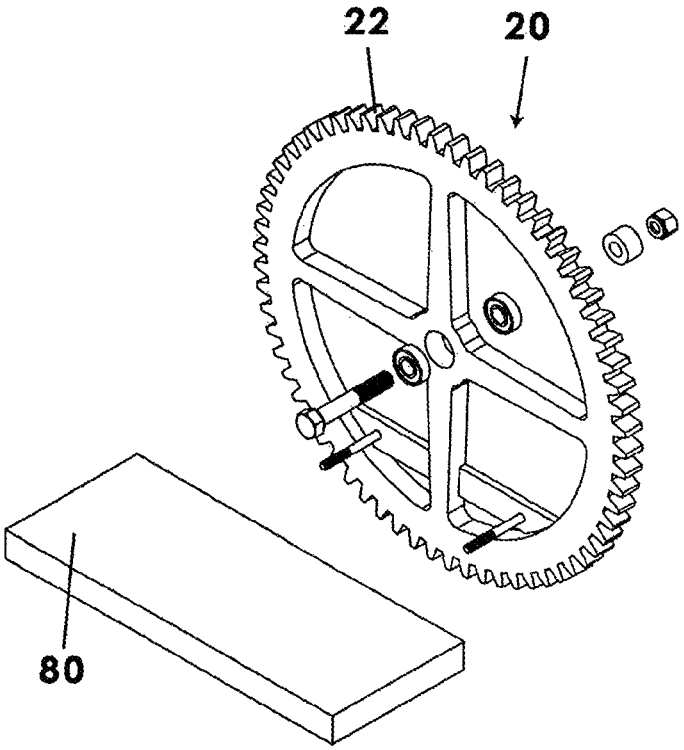
FIG. 9*b* is an exploded view of the planetary gear illustrated in FIG. 9*a;*

Described in even more detail, the multi-wheel rotational shelving assembly 10 includes a drive wheel 20 having the configuration of a circular plate that may be attached to a forward end of the shaft 62 (FIG. 8). It is understood that the drive wheel 20 may include an axial aperture or slot configured to receive the shaft 62 that extends longitudinally from the mounting plate 60. Again, the drive wheel 20 has a generally fixed position and is not rotatable other than for initial calibration or leveling as will be described later. Specifically, the drive wheel 20 may be threadably attached to the shaft 62 in a friction fit engagement (FIG. 7) and may also be attached to a faceplate 25 via a plurality of slot nuts 25*b*, as will be described in greater detail later. The drive wheel 20 includes a peripheral edge having a predetermined number of teeth 22 and defining a first diameter.

In an embodiment, the teeth associated with the drive wheel 20 have a predetermined size and spacing. In use, the drive wheel 20 is positioned in an upright and vertical configuration, i.e., the drive wheel 20 extends upwardly on its peripheral edge of teeth and has a frontside edge 21*a* and a backside edge 21*b*. Geometrically, the drive wheel 20 is mounted axially on the center point of the circle/ring defined by the peripheral frame member 12.

Further, the multi-wheel rotational shelving assembly 10 includes an orbiting wheel assembly having a plurality of orbiting wheels 30 arranged in a circular array, each orbiting wheel being displaced an identical distance away from the peripheral edge of drive wheel 20 and each orbiting wheel being displaced an equal distance away from a next adjacent orbiting wheel 30. Further, each orbiting wheel 30 has a continuous peripheral edge defining a circular plate-like configuration having a second predetermined number of teeth 42 and defining a second diameter. Preferably, each orbiting wheel 30 is positioned in an upright and vertical configuration, i.e., each orbiting wheel 30 extends upwardly on its peripheral edge of teeth and has a frontside edge 31*a* and a backside edge 31*b*. In a critical aspect, the second predetermined number of teeth is equal to the first predetermined number of teeth 32 and the second diameter is equal to the first diameter. As will be discussed below in greater detail, this equality of teeth is critical to maintaining the shelves in a perpetually level orientation as the orbiting wheels 30 revolve around (i.e., orbit) the drive wheel 20.

Each orbiting wheel 30 includes an axle that is pivotally coupled to the peripheral frame member 12 so that the orbiting wheel 30 is free to revolve about the axis defined by the axle. Further, attachment of the orbiting wheel 32 to the peripheral frame member 12 causes the orbiting wheel 30 and its shelf 70 to orbit about the drive wheel 20. Geometrically, the plurality of orbiting wheels 30 are positioned as an array along the outer circumference defined by the peripheral frame member 12.

In addition, the multi-wheel rotational shelving assembly 10 includes a planetary wheel assembly having a plurality of planetary wheels 40. Again, each planetary wheel 40 has a circular and plate-like configuration and a peripheral edge having a plurality of teeth 42. Each planetary wheel 40 defines third diameter. Importantly, the number and configuration of teeth and diameter of each planetary wheel can be—but is not required to be—equal to the number of teeth and diameters of the drive wheel and orbiting wheels. Each planetary wheel 40 is pivotally coupled to a respective spoke 13 of the framework. Geometrically, the plurality of planetary wheels 40 are arranged as an array about a line that defines an intermediate circumference of the circle defined by the peripheral frame member 12. In use, the plurality of planetary wheels is positioned intermediate the plurality of orbiting wheels 30 and the drive wheel 20. More particularly, the teeth 42 of each planetary wheel 40 is operatively and simultaneously engaged, on one side, with the teeth 32 of corresponding orbiting wheels 30 and, on another side, with the teeth 22 of the drive wheel 20.

In the primary and most critical aspect of the invention, the multi-wheel rotational shelving assembly 10 includes a plurality of shelves 70 coupled to the plurality of orbiting wheels 30, respectively, and to the drive wheel 20. More particularly, each shelf 70 is fixedly attached to a frontside edge 31*a* of an orbiting wheel 30, respectively. Further, each shelf 70 has a flat or planar configuration that is level or parallel with a floor surface. In other words, each shelf 70 defines a horizontal plane that is generally perpendicular to a vertical plane defined by the frontside edge 31*a*. As has been explained in detail above, the plurality of shelves 70 remain level throughout operation and engagement of the wheels described above.

Similarly, an auxiliary shelf 80 is coupled to the front side edge 21*a* of the drive wheel and extends forwardly therefrom. The auxiliary shelf 80 has a flat or planar configuration that is level or parallel with a floor surface. Obviously, the auxiliary shelf 80 maintains its level orientation in that the drive wheel 22 to which it is attached does not rotate except as will be described specifically below.

Attachment of the driveshaft to the faceplate 25 introduced above may be with a plurality of fasteners such as shaft bolts 25*a*. The faceplate 25, therefore, may be tightened and fixed unless and until the shaft bolts 25*a* are loosened and a calibration process is initiated as explained below. In this critical aspect, the drive wheel 20 may be loosened from being fixedly attached to the faceplate 25 and shaft 62 and, in its loosened state, the drive wheel 20 may be gently rotated so as to calibrate the auxiliary shelf 80 into its preferred level configuration. This calibration or rotation is possible because of the unique configuration of the faceplate 11. More particularly, the faceplate 25 defines a plurality of slots 25*c*, each slot having an arched configuration, the faceplate 25 including a plurality of fasteners 25*a* and slot nuts 25*b* positioned in respective slots 25*c*. Accordingly, the bolts by which the drive wheel 20 is tightly fastened to the faceplate 25 may be loosened such that slot nuts 25*b* may be moved along corresponding slots 25*c*, the rotational movement that involves slightly rotating the drive wheel itself so as to level up the auxiliary shelf 80. Thereafter, the bolts may be tightened down such that the drive wheel 20 is once again fixedly attached to the hub 50 and not rotatable.

Figure 2:
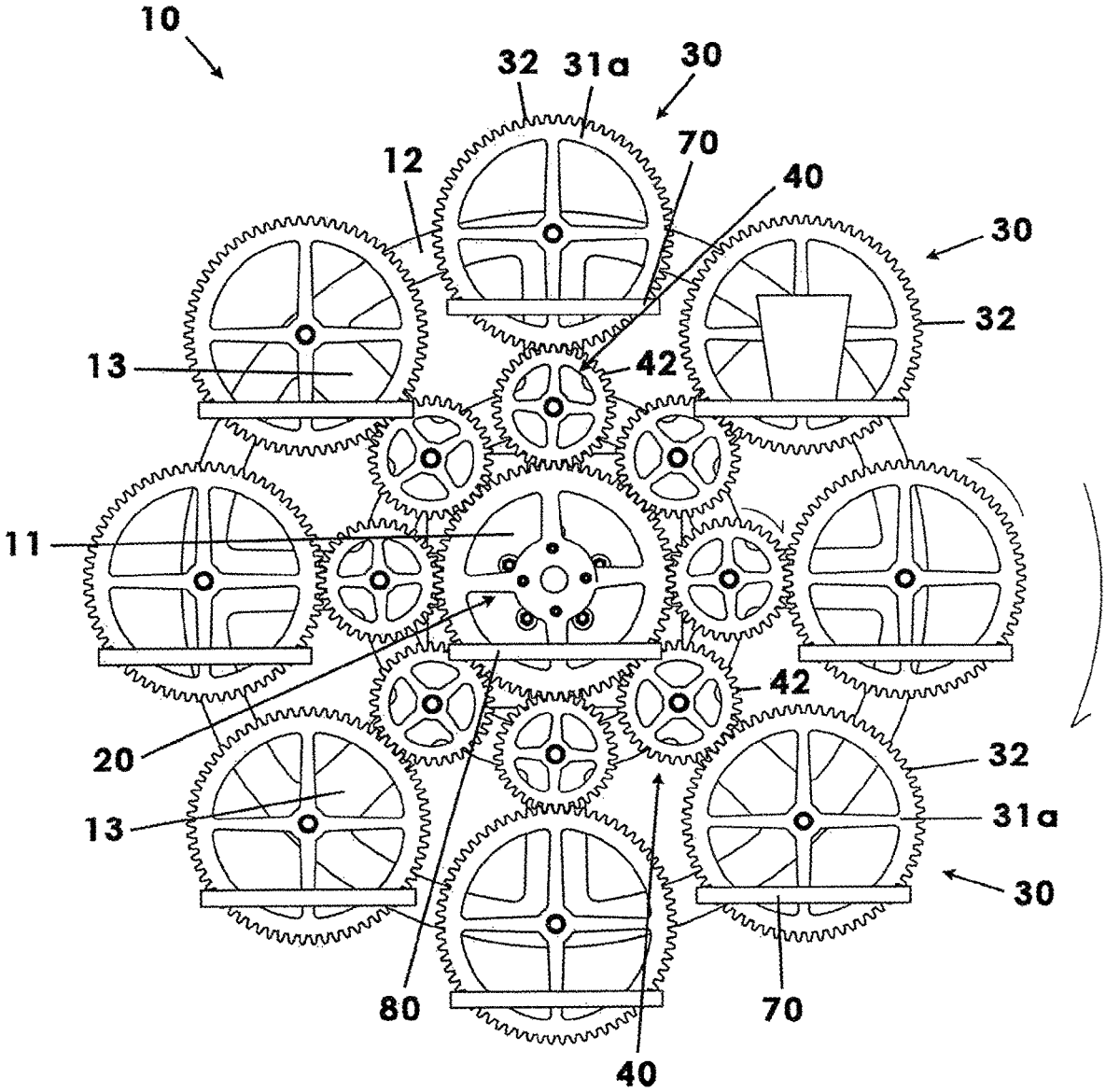
FIG. 2 is a front view of the multi-wheel rotational shelving assembly as in FIG. 1, illustrated with the shelves in a first position.
Figure 3:
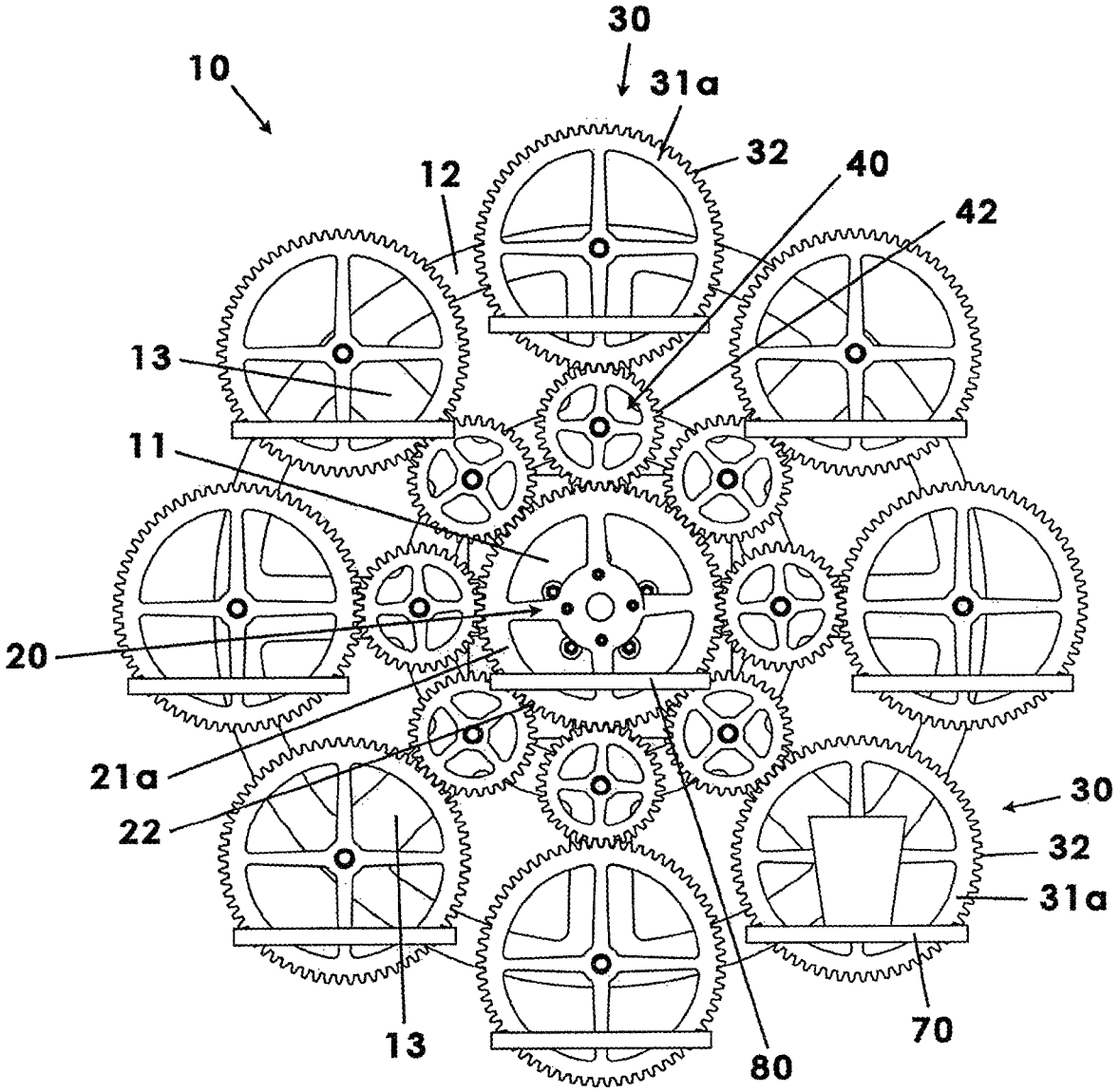
FIG. 3 is another front view of the multi-wheel rotational shelving assembly as in FIG. 2, illustrated with the shelves rotated to a second position.

In use, the user may manually grasp and rotate the peripheral frame member 12 which causes rotation of itself and the array of orbiting wheels 30 as seen by comparing movement of the face shown in FIGS. 2 and 3. Further, this clockwise rotation causes the plurality of planetary wheels 40 to also move in a rotational orbit about the drive wheel 20 which causes a counterclockwise movement of the plurality of orbiting wheels 30, respectively. Respective shelves 70, however, are maintained in a level configuration because the predetermined number of teeth 22 about the drive wheel 20 are the same as the predetermined number of teeth 32 of the plurality of orbiting wheels 30, respectively. The direction of rotation of respective wheels are indicated with arrows in FIG. 2. The direction of rotation, of course, may be reversed.

Figure 5A:
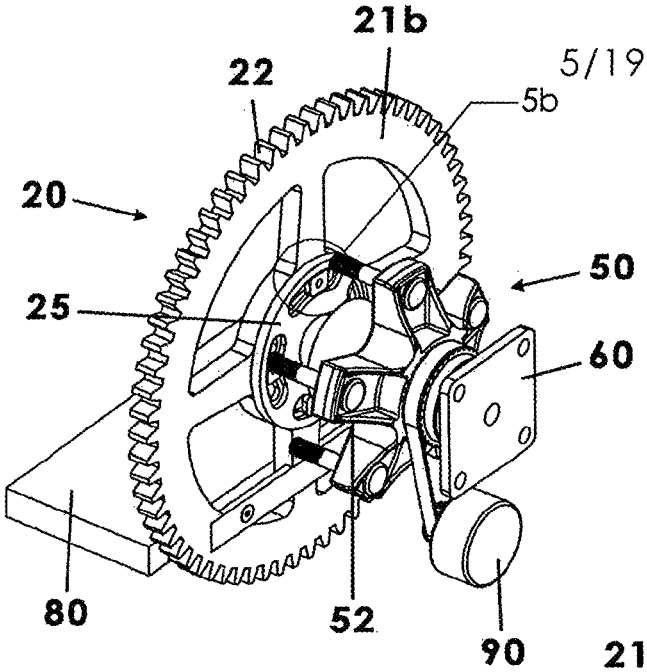
FIG. 5*a* is a rear perspective view of the drive wheel as in FIG. 4*b*, illustrated in isolation.
Figure 5C:
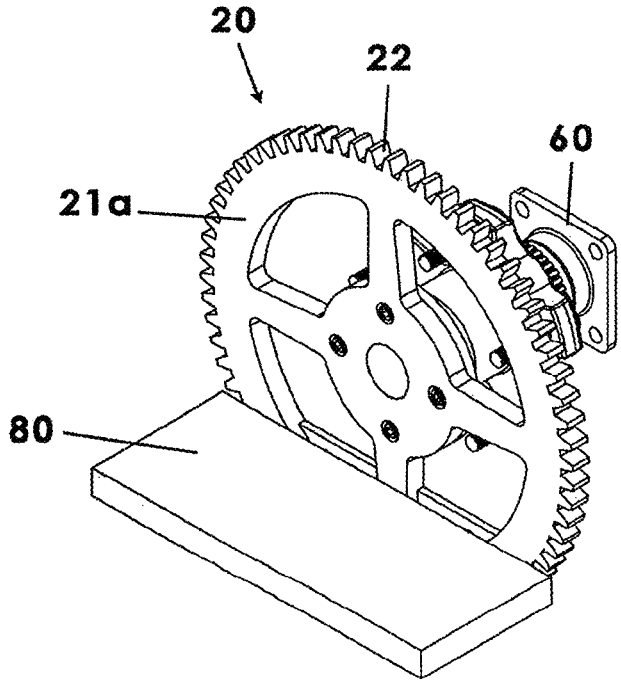
FIG. 5*c* is a front perspective view of the drive wheel as illustrated in FIG. 5*a;*
Figure 5B:
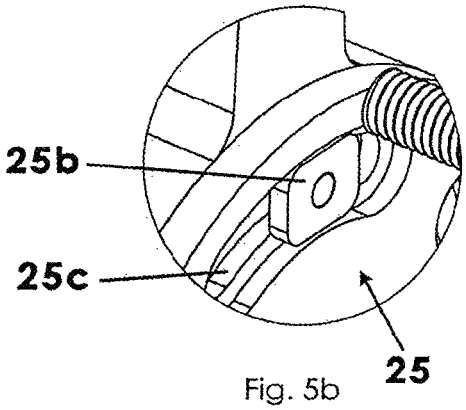
FIG. 5*b* is an isolated view on an enlarged scale taken from FIG. 5*a;*

In one more aspect, rotation of the peripheral frame member 12 may be actuated via operation of a motor 90 and belt combination as shown in FIGS. 5 and 6. More particularly, the motor and belt combination may be mounted forwardly proximate the mounting plate 60 and the belt is coupled to the hub 50. Therefore, when the motor is actuated, such as by operation of an on/off button or other activation of a battery or connection to AC electricity, the belt will operate the hub to rotate which, as described above, rotates the peripheral frame member and all gear wheels attached thereto.

Figure 12A:
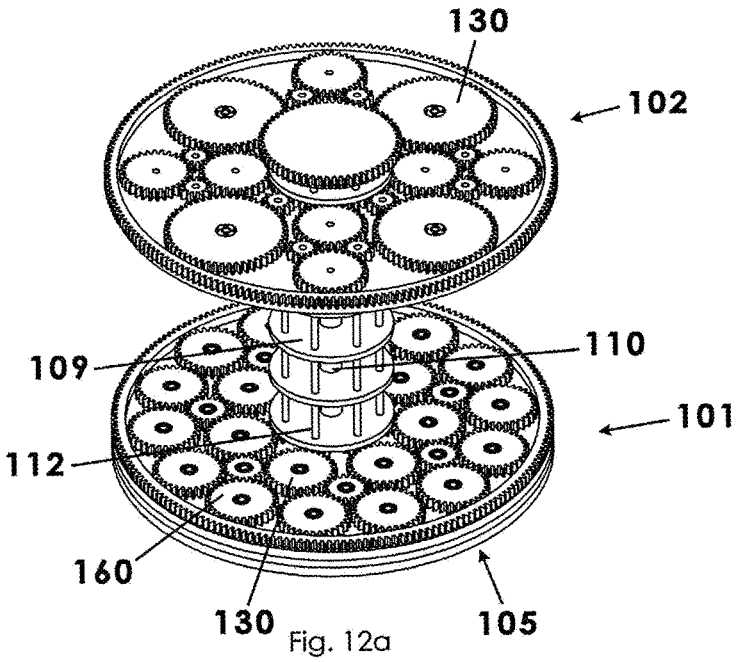
FIG. 12*a* is a perspective view of the display assembly as in FIG. 10, illustrating a 2-tier configuration.
Figure 12B:
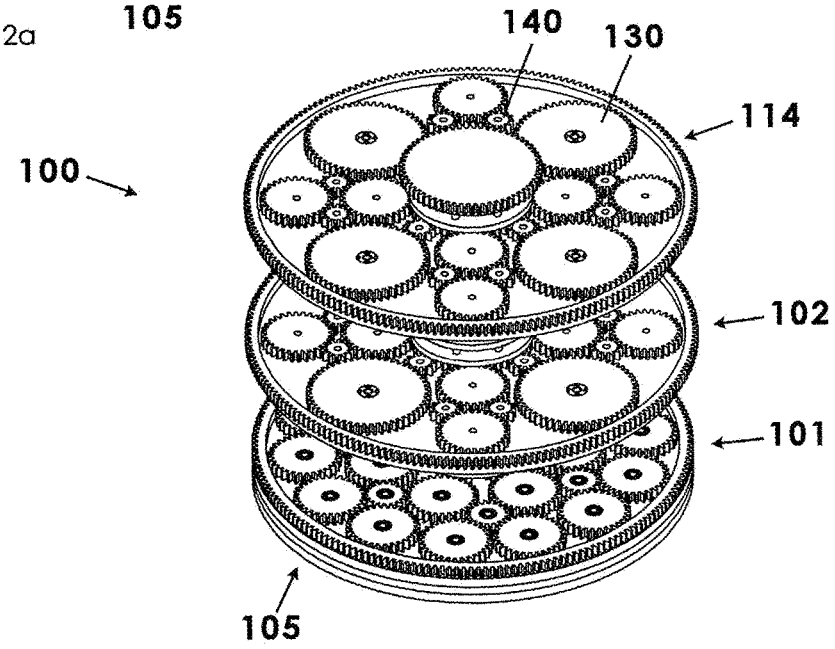
FIG. 12*b* is a perspective view of the display assembly as in FIG. 10, illustrating a 3-tier configuration.
Figure 13:
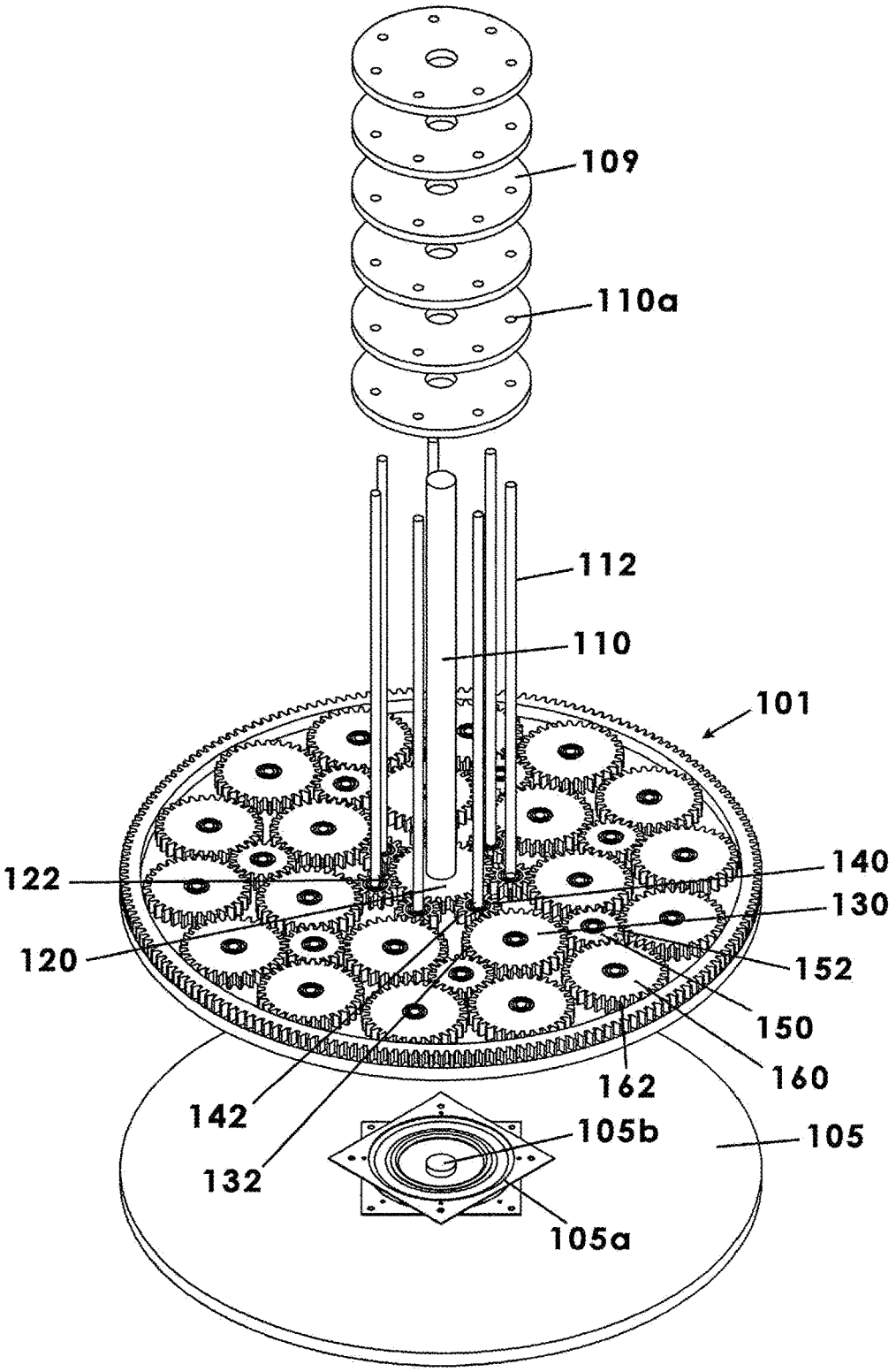
FIG. 13 is an exploded view of the display assembly as in FIG. 12*a;*

With reference to FIGS. 10 to 17, another embodiment of the present invention discloses a rotational wheel display assembly 100 that includes a construction that is substantially related to the rotational wheel shelving assembly 10 described above except as specifically noted below. As shown in FIG. 13*a*, the rotational wheel display assembly 100 includes at least a lower display portion 101 and an upper display portion 102 both of which include a lower circular plate 101*a* and an upper circular plate 102*a*, each positioned in a respective horizontal plane, the pair of circular plates being vertically displaced from one another yet parallel or concentric to one another. As shown in FIG. 13, the rotational wheel display assembly 100 includes a base assembly 105 positioned adjacent but beneath the lower display portion 101, the base assembly 105 having a Lazy-Susan bearing 105*a* upon which the lower display portion 101 is supported in a configuration that allows the lower display portion 101 to rotate within its respective horizontal plane. The Lazy-Susan bearing 105*a* includes a flange 105*b*.

The lower display portion 101 defines a radial aperture 101*b*, i.e., the radial aperture 101*b* being located at the radial center point thereof. Similarly, the upper display portion 102 defines an axial aperture having the same construction (located at a geometric center point of a respected display portion). Further, the rotational wheel display assembly 100 includes an upstanding shaft 110 having an elongate and cylindrical configuration that defines a longitudinal vertical axis, the shaft 110 having a first end fixedly coupled to the flange 105*b* and extending upwardly through the axial apertures 101*b*. It will be understood that the upstanding shaft 110 is not coupled to the lower circular plate 101 or upper circular plate 102 but rather is allowed to extend therethrough unabated. In other words, the shaft 110 is static and does not rotate whereas the lower display portion 101 and upper display portion 102 are rotatable within respective horizontal planes as will be described later.

As shown in FIG. 13, the rotational wheel display assembly 100 may include a plurality of support rods 112 each extending upwardly between vertically displaced tiers, such as between the lower display portion 101 and the upper display portion 102. Preferably, each support rod 112 may have an elongate configuration that extends through the at least lower and upper portions or any quantity of tiers that may be assembled in vertical succession. It will be understood that the plurality of support rods 112 provide the primary physical support between successive circular portions (i.e., tiers) and, in addition, provide the interface and link such that a rotation of the lower display portion 101 causes the upper display portion 102 to rotate equally, and so on if more tiers are provided (as shown in FIG. 13). Further, the present display assembly 100 may include a plurality of support brackets 109 that may be positioned one atop another to provide additional support after which the plurality of support rods 112 (described below) may extend (FIGS. 12*a* and 13).

In other words, the present invention may include a plurality of display portions or circular tiers connected by the plurality of support rods 112 for the sake of increasing the height of the display apparatus or as a means to vertically displace the lower display portion 101 and the upper display portion 102 (FIG. 13). Stated another way, the plurality of support rods 112 are a means for transferring rotational torque from a lower display portion to a next contiguous upper display portion to which they are connecting. Further, an upper surface of the lower display portion 101 may define a plurality of holes 110*a* arranged in a radial pattern surrounding the radial aperture 101*b*, each hole 110*a* being configured to receive a lower end of a support rod 112 in a friction fit construction. In an embodiment, the multi-wheel rotational display assembly 100 may include a top display portion 114 (FIG. 12*b*) having a configuration and construction substantially similar to the portions described above and as will be discussed later in greater detail. Each display portion may include a peripheral edge 98*a*, 98*b* having a plurality of teeth or similar gripping surface so that a user may grasp and impart rotational motion thereto. Alternatively, at least one of the display portions may be operatively coupled to a motor so as to apply selective mechanical rotation.

In this embodiment, a plurality of wheel assemblies is arranged and engaged atop respective display portions. Description of the groupings of display portions will be described with reference to FIG. 15 of the accompanying drawings. More particularly, the multi-wheel rotational display assembly 100 includes a drive wheel 120 corresponding to each circular display portion (i.e., to the lower display portion 101 and the upper display portion 102) surrounded by respective planetary wheel assemblies 140 which are then surrounded by respective orbiting wheel assemblies 130. It is understood that each "wheel" referenced below in the preferred embodiment, is a "gear" having a plurality of peripheral teeth and is pivotally mounted so as to be rotatable unless specifically described otherwise.

Figure 14:
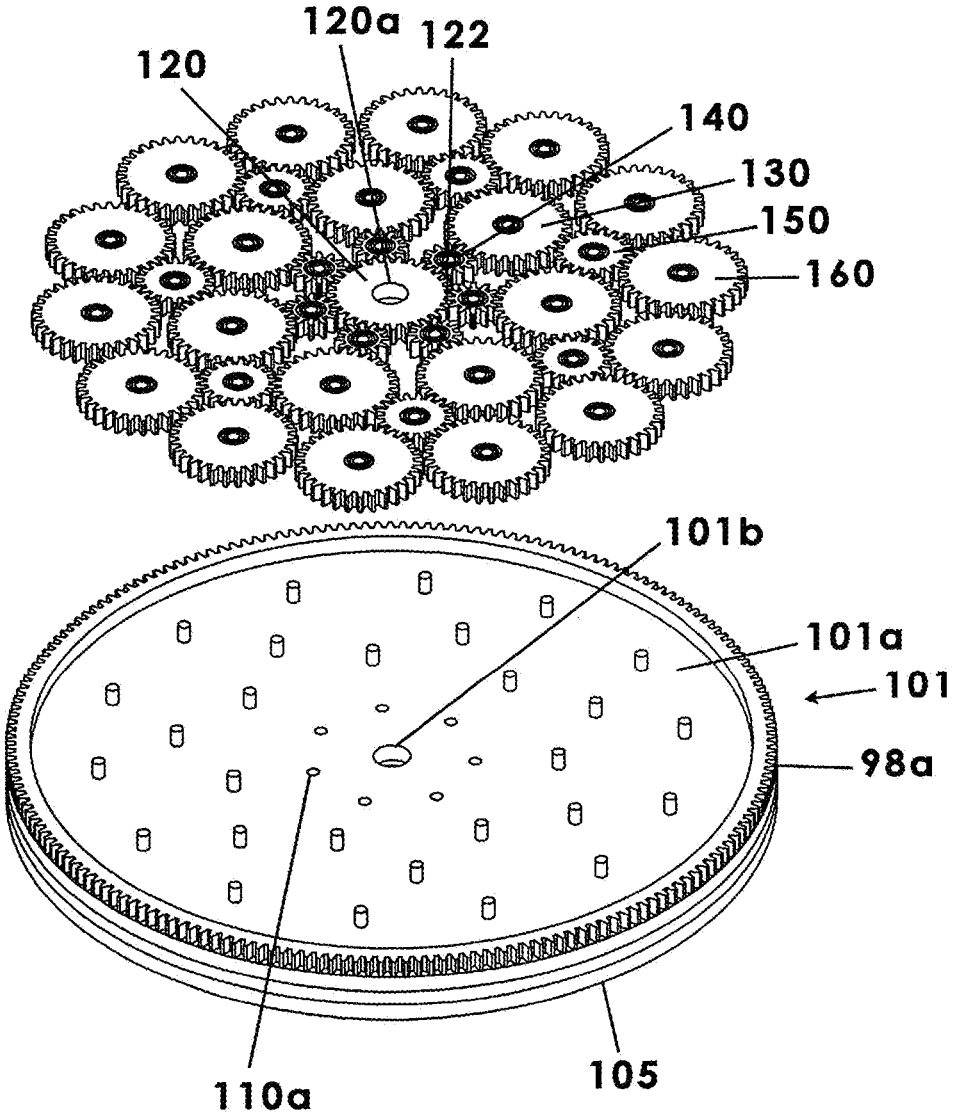
FIG. 14 is an exploded view of a lower display portion of the display assembly as in FIG. 10.
Figure 15:
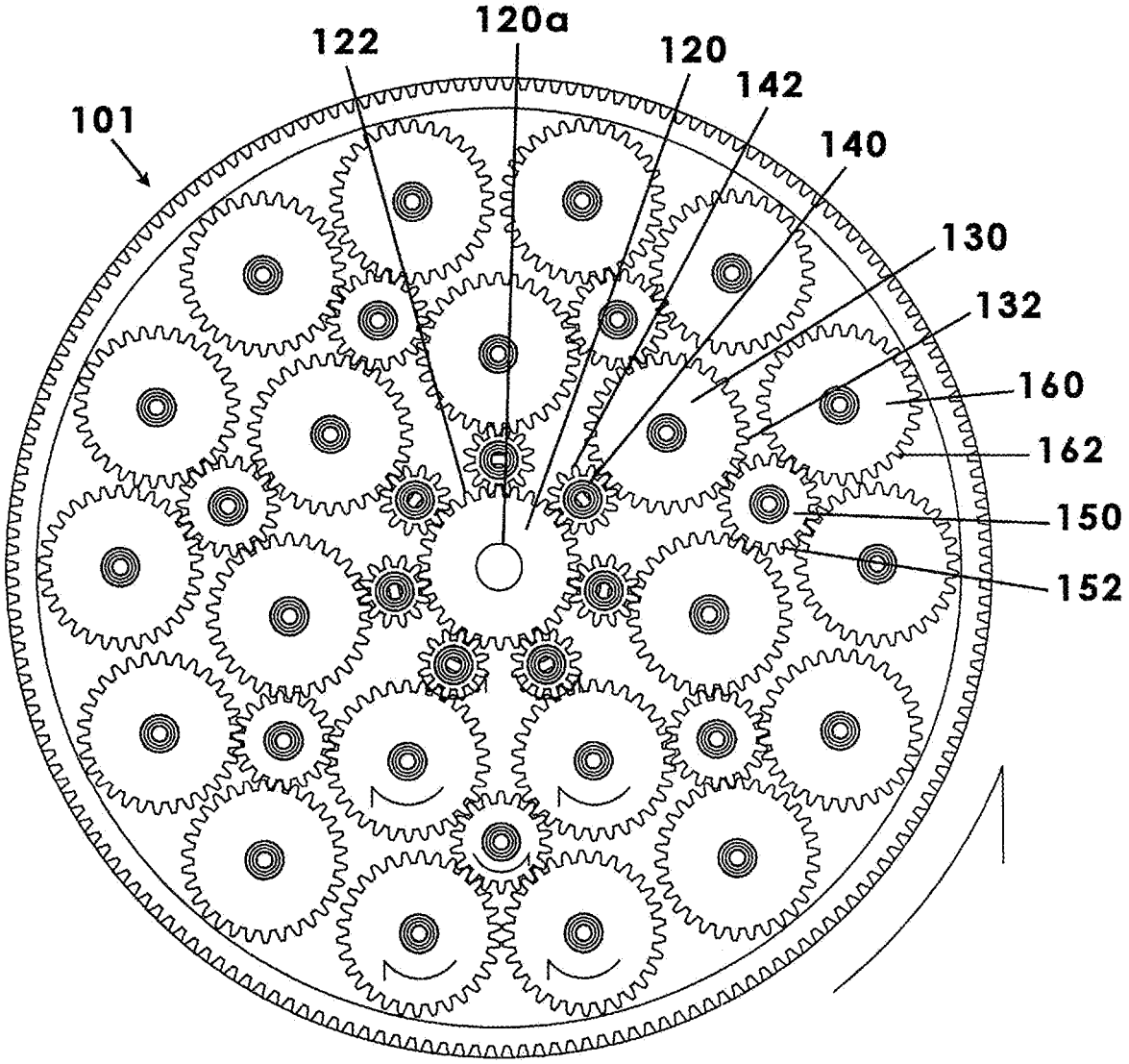
FIG. 15 is a top view of the lower display portion of FIG. 14.

Described in even more detail, the multi-wheel rotational shelving assembly 100 includes a drive wheel 120 corresponding to each tier or portion and having the configuration of a circular plate that may first be fixedly attached to the first end (bottom) of the shaft 110 (FIG. 14). It is understood that the shaft 110 and its corresponding drive wheel 120 have a fixed position and are not rotatable. The drive wheel 120 includes a plurality of teeth 122 and defines a void 120*a* through which the shaft 110 passes.

As indicated above, each drive wheel 120 may be surrounded by a plurality of spaced apart orbiting wheel assemblies each having a plurality of orbiting wheels 130 arranged in a circular array, each orbiting wheel being displaced an identical distance away from the peripheral edge of drive wheel 120 and each orbiting wheel being displaced an equal distance away from a next adjacent orbiting wheel 130. Further, each orbiting wheel 130 has a continuous peripheral edge defining a circular plate-like configuration having a second predetermined number of teeth 132 and defining a second diameter. Preferably, each orbiting wheel 130 is positioned in a horizontal configuration, i.e., each orbiting wheel 130 extends in a horizontal plane on its peripheral edge of teeth and has a frontside edge and a backside edge. In a critical aspect, the second predetermined number of teeth is equal to the first predetermined number of teeth 132 and the second diameter is equal to the first diameter. As will be discussed below in greater detail, this equality of teeth is critical to maintaining the articles 115 in a perpetually consistent orientation as the orbiting wheels 130 revolve around (i.e., orbit) the drive wheel 120.

Each orbiting wheel 130 includes an axle that is pivotally coupled to the peripheral lower display portion 101 so that the orbiting wheel 130 is free to revolve about the axis defined by the axle. Further, attachment of the orbiting wheel 132 to the lower display portion 101 causes the orbiting wheel 130 and any article 115 positioned thereon (e.g., mug, cupcake, or the like) to orbit about the drive wheel 20. Geometrically, the plurality of orbiting wheels 30 are positioned as an array along the outer surface defined by the lower display portion 101.

Figure 17:
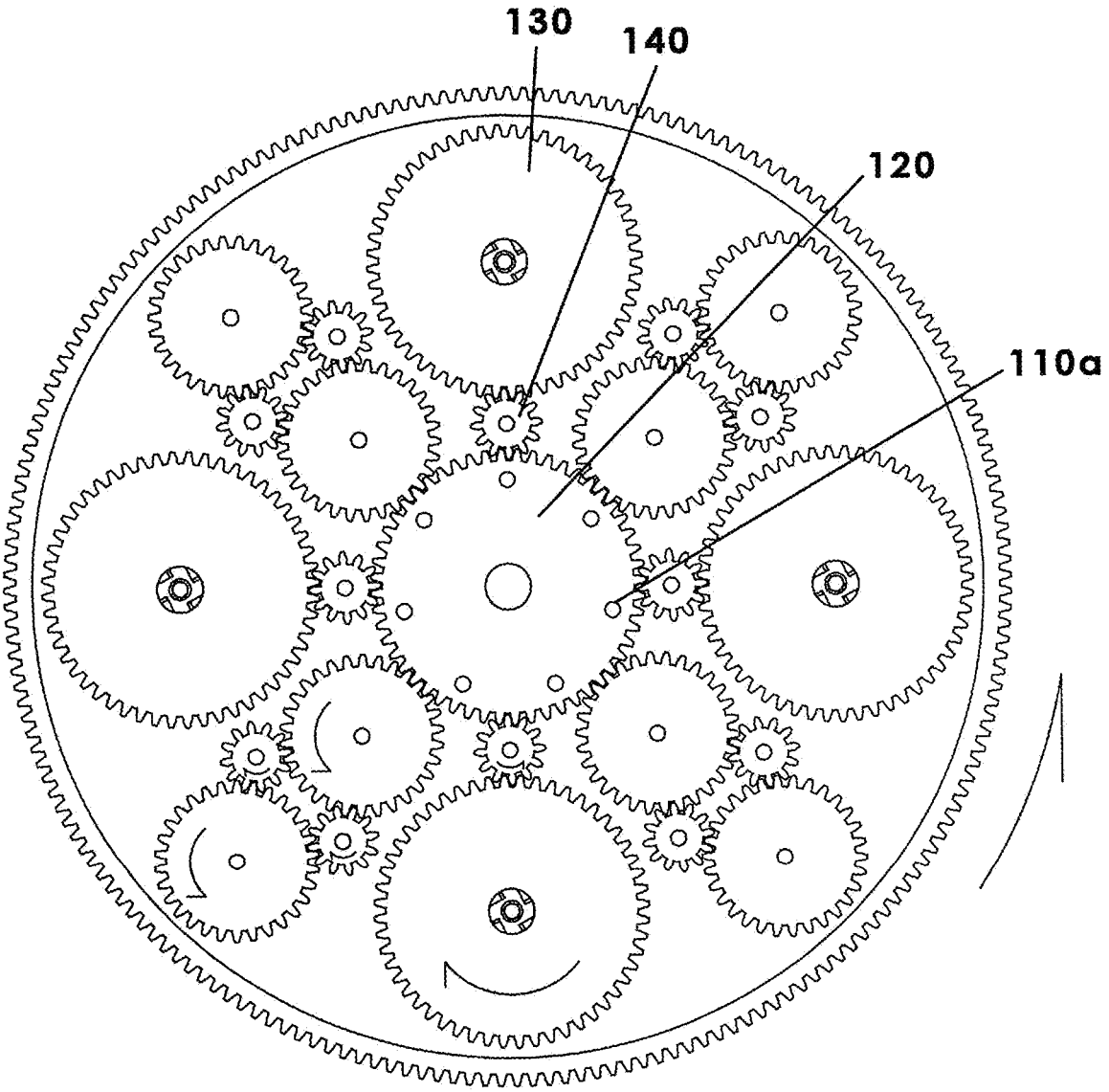
FIG. 17 is a top view of the upper display portion shown in FIG. 16*a*.

In addition, the multi-wheel rotational display assembly 100 includes a planetary wheel assembly having a plurality of planetary wheels 140 (FIG. 17). Again, each planetary wheel 140 has a circular and plate-like configuration and a peripheral edge having a plurality of teeth 142. Each planetary wheel 140 defines a third diameter. Importantly, the number and configuration of teeth and diameter of each planetary wheel can be—but is not required to be—equal to the number of teeth and diameters of the drive wheel 120 and orbiting wheels 130. Each planetary wheel 140 is pivotally coupled to an upper surface of the lower display portion 101. In use, the plurality of planetary wheels 140 is positioned intermediate the plurality of orbiting wheels 130 and the drive wheel 120. More particularly, the teeth 142 of each planetary wheel 140 is operatively and simultaneously engaged, on one side, with the teeth 132 of corresponding orbiting wheels 130 and, on another side, with the teeth 122 of the drive wheel 120.

In an embodiment, there may be an outer tier of orbital and planetary wheels in addition to those described above. For instance, a plurality of outer tier orbital wheels 160 are mounted to the lower display portion 101 and positioned in a spaced apart array along the outer peripheral edge of the circular lower display portion 101. Each outer tier orbital wheel 160 includes a plurality of gear teeth 162. Further, a plurality of outer tier planetary gears 150 are pivotally mounted to the lower display portion 101 and positioned intermediate the plurality of orbiting wheels 130 and the plurality of outer tier orbiting wheels 160. Each outer tier planetary wheel 150 includes a plurality of peripheral gear teeth 152. As shown in FIG. 8, the respective teeth 152 of an outer tier planetary wheel 150 may, on one side, be engaged with the respective teeth 132 of a respective orbiting wheel 130 and, on the other side, be engaged with the respective teeth 162 of a respective outer tier orbiting wheel 160. In an embodiment, each outer tier planetary wheel 150 may be operatively engaged with additional adjacent orbiting wheels 130/160. It will be further understood that respective diameters and quantity of gear teeth include dimensions such that articles (e.g., mugs, cupcakes, and the like) positioned atop upper faces of respective wheels will maintain a constant orientation.

Figure 10:
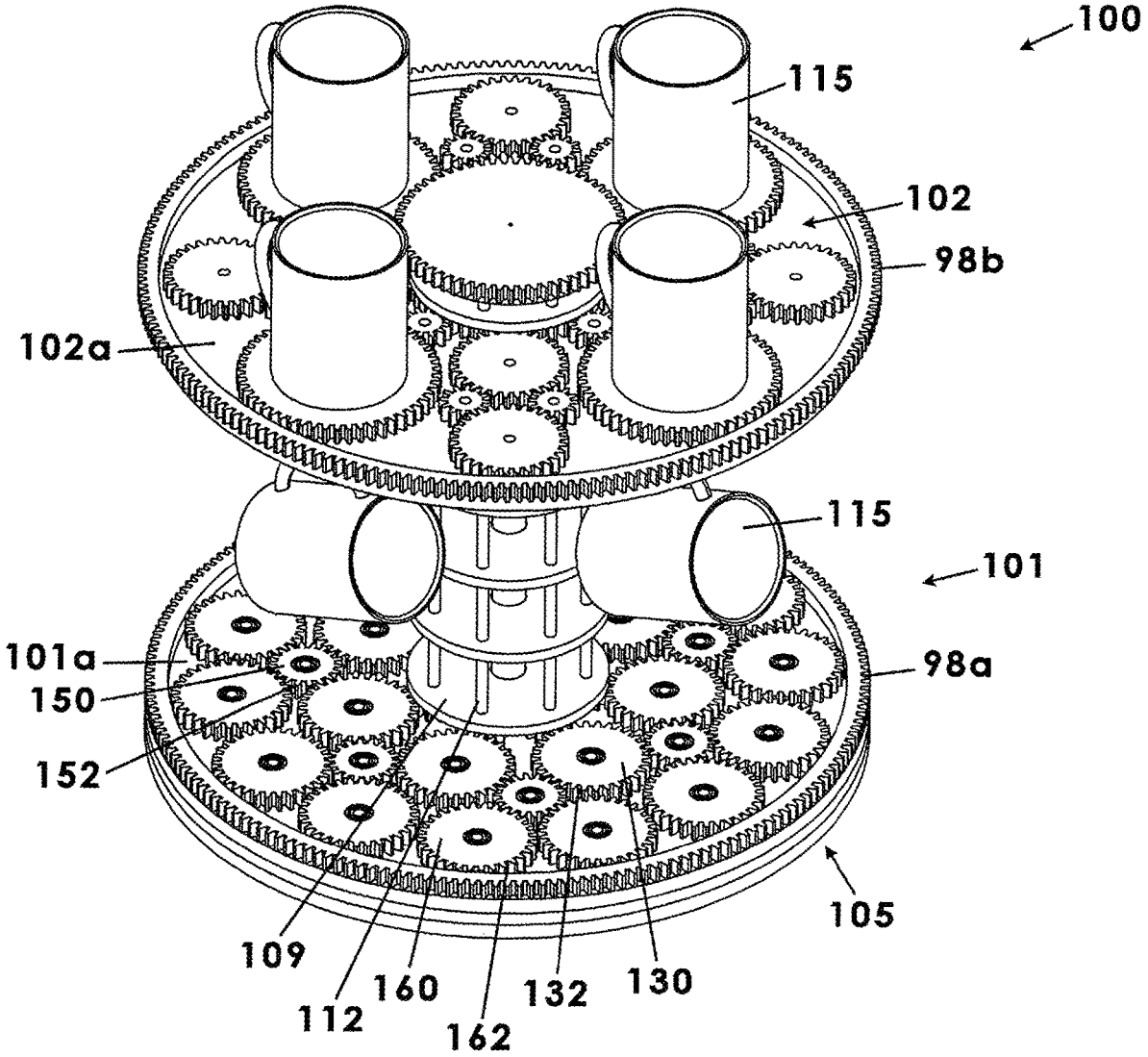
FIG. 10 is a perspective view of a multi-wheel rotational display assembly according to a preferred embodiment of the present invention.
Figure 11A:
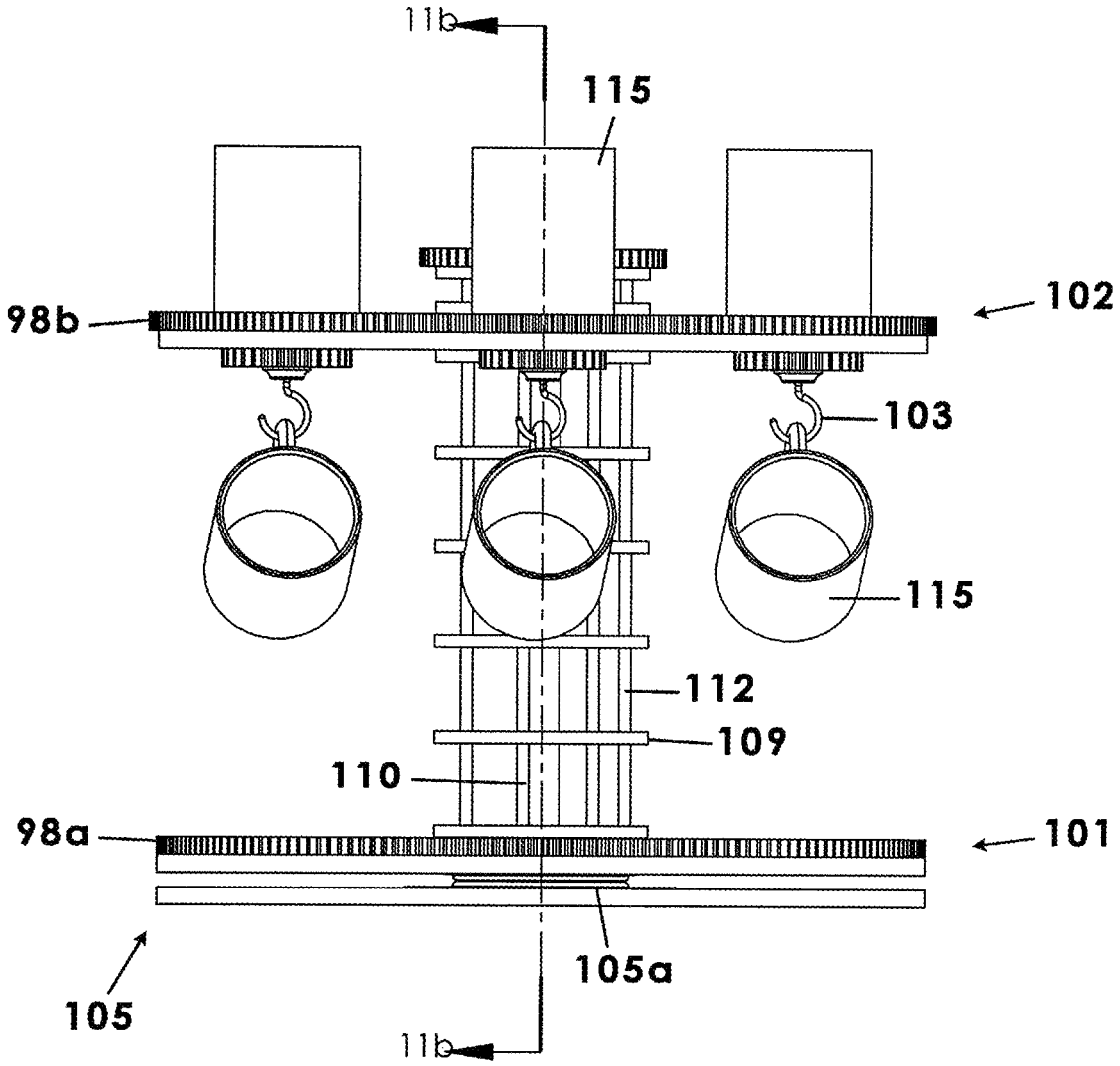
FIG. 11*a* is a side view of the display assembly as in FIG. 10.
Figure 11B:
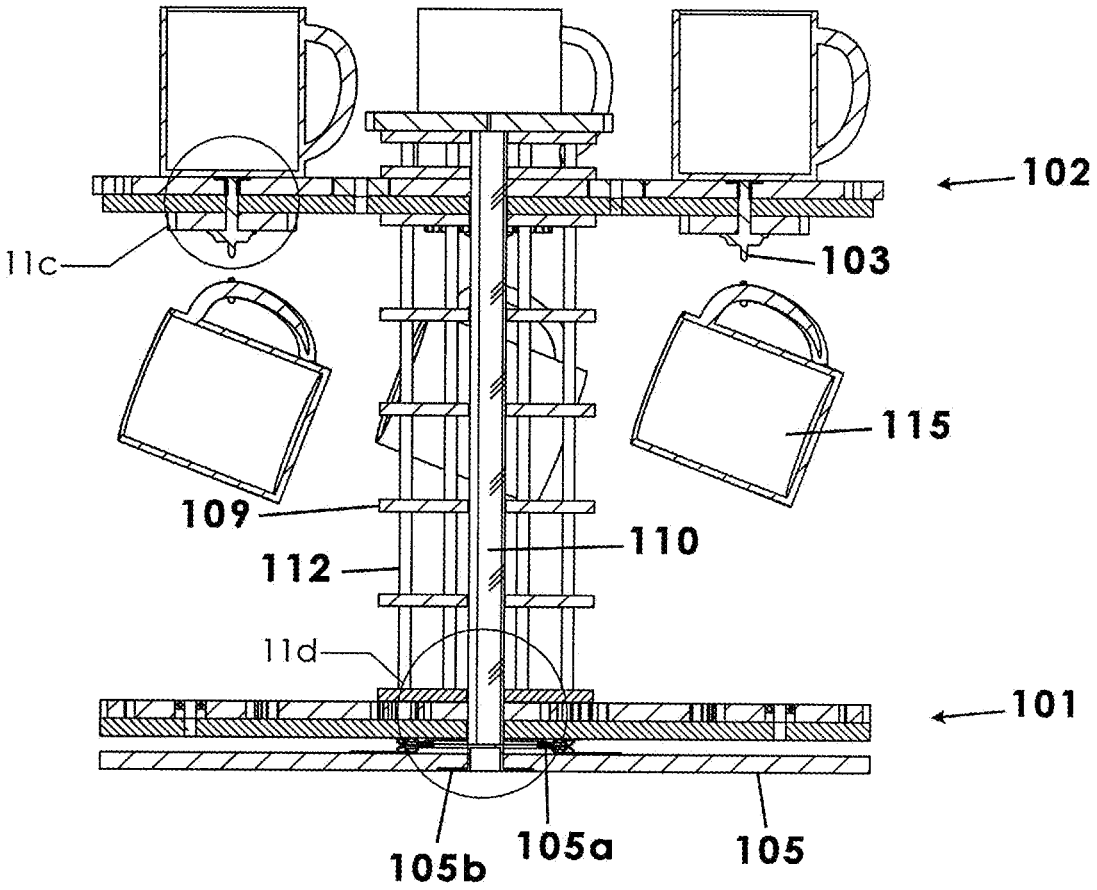
FIG. 11*b* is a sectional view taken along line 11*b*-11*b* of FIG. 11*a;*
Figure 11C:
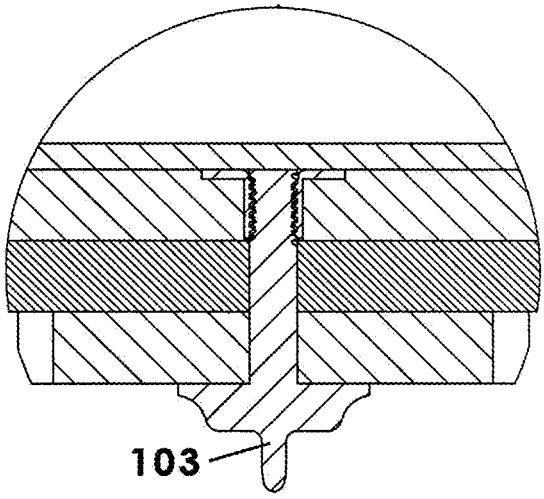
FIG. 11*c* is an isolated view on an enlarged scale taken from FIG. 11*b;*
Figure 11D:
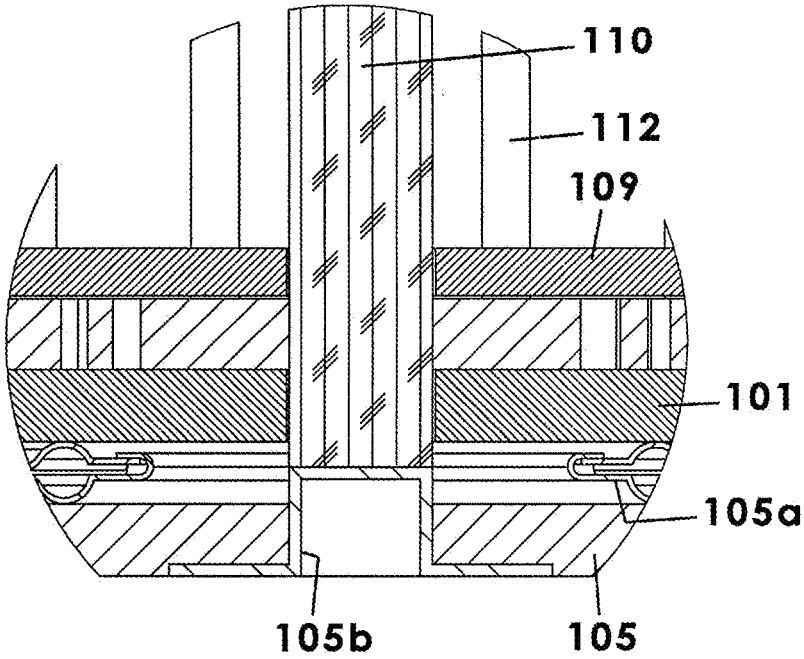
FIG. 11*d* is an isolated view on an enlarged scale taken from FIG. 11*b;*
Figure 16A:
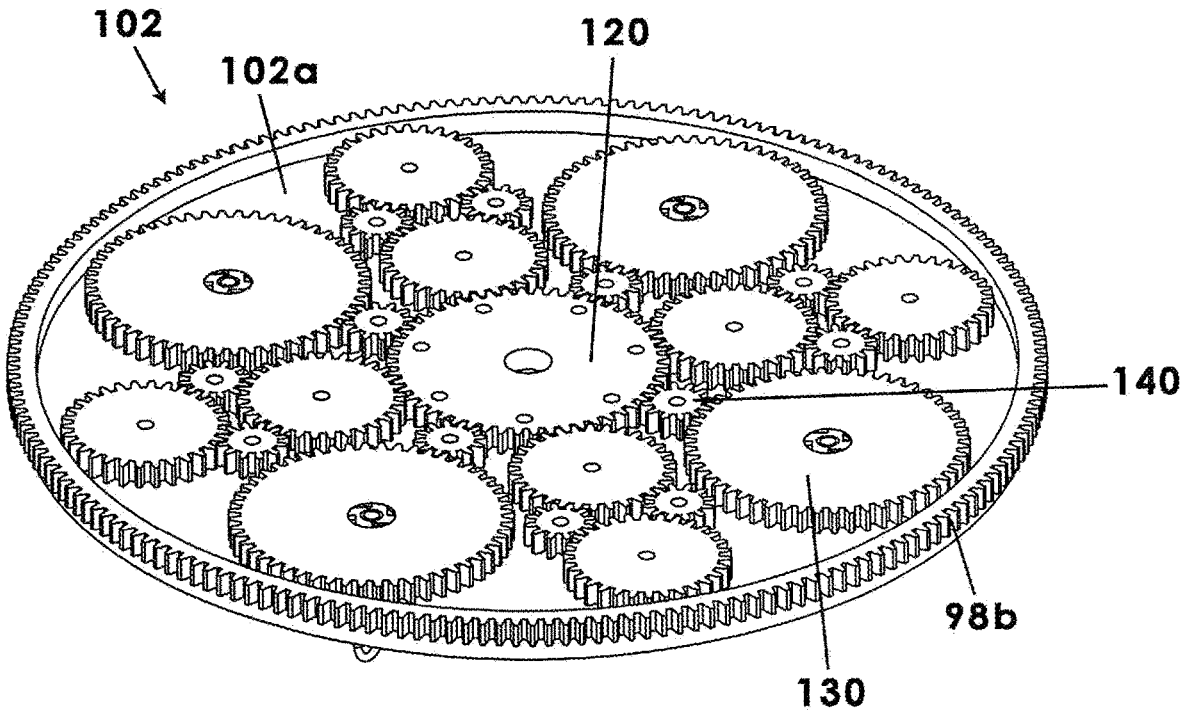
FIG. 16*a* is an elevated view of an upper portion of the display assembly as in FIG. 10.
Figure 16B:
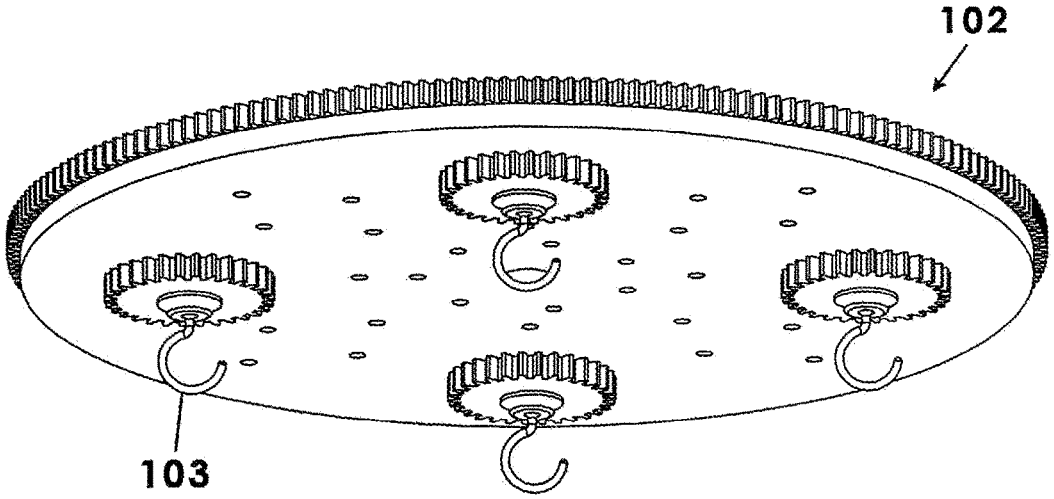
FIG. 16*b* is a lower perspective view of the upper portion as in FIG. 16*a*.

As shown in FIGS. 16*a* to 17, all display portions that are coupled together in the present invention need not have the same quantity and configuration of locating wheels. As shown in FIG. 10, for example, the lower display portion 101 may include many more wheel assemblies than are positioned on the upper display portion 102. An obvious reason for this disparity may be that more articles 115 (e.g., mugs) are positioned atop respective wheels on the upper display portion 102 than on the lower display portion 101. In a related aspect, the upper display portion 102 may include a plurality of hooks 103 extending downwardly from a bottom surface thereof, each hook 103 being configured to receive a handle of a mug 115 (FIG. 10), such that the mug 115 will rotate along with rotation of the upper display portion 102. As shown in FIGS. 16*b* and 11*c*, each hook may include a mounting shaft that provides the axle by which a corresponding mounting wheel may be pivotally coupled to a bottom side of the upper display portion 102.

It is understood that while certain forms of this invention have been illustrated and described, it is not limited thereto except insofar as such limitations are included in the following claims and allowable functional equivalents thereof.

The invention claimed is:

1. A multi-wheel rotational display assembly, comprising:

a base member having an unmovable configuration and that includes a Lazy-Susan bearing and a flange;

a shaft that includes a first end fixedly coupled to said flange, said shaft extending upwardly from said flange and having a linear configuration defining an imaginary longitudinal axis;

a lower display portion having a generally circular and planar configuration that defines a horizontal plane and that includes opposed upper and lower surfaces and a peripheral edge that includes a plurality of teeth, said lower display portion being rotatably coupled atop said Lazy-Susan bearing;

a lower portion drive wheel fixedly coupled to said shaft and positioned in said horizontal plane of said lower display portion so as to be unrotatable, said lower portion drive wheel including a peripheral edge having a first predetermined number of teeth and having a circular configuration defining a first diameter;

an orbiting wheel assembly having a plurality of orbiting wheels each being displaced from an adjacent orbiting wheel and being displaced a predetermined distance from said peripheral edge of said drive wheel, said plurality of orbiting wheels each including a peripheral edge having a second predetermined number of teeth and having a circular configuration defining a second diameter;

wherein said second predetermined number of teeth is equal to said first predetermined number of teeth;

a planetary wheel assembly having a plurality of planetary wheels each being displaced from an adjacent planetary wheel and being situated intermediate a corresponding orbiting wheel and said lower portion drive wheel, said plurality of planetary wheels each including a peripheral edge having a third predetermined number of teeth and having a circular configuration defining a third diameter;

wherein respective teeth of said each planetary wheel are operatively and simultaneously engaged with a respective tooth of said lower portion drive wheel and with a respective tooth of a respective orbiting wheel.

2. The display assembly as in claim 1, further comprising:

an upper display portion upwardly displaced from and parallel to said lower display portion and having a generally circular and planar configuration that defines a horizontal plane and includes opposed upper and lower surfaces and a peripheral edge that includes a plurality of teeth, said lower display portion and said upper display portion each defining an axial aperture through which said shaft freely extends;

a plurality of support rods, each support rod having an elongate and linear configuration that includes a first end coupled to said lower display portion and an upper end coupled to said upper display portion such that said upper display portion is supported by respective support rods;

a plurality of outer tier orbital wheels mounted in a spaced apart array along and proximate the peripheral edge of the lower display portion, each outer tier orbital wheel being pivotally coupled to the upper surface of the lower display portion and each having a peripheral edge that includes a plurality of teeth; and a plurality of outer tier planetary wheels pivotally mounted to the upper surface of the lower display portion and positioned intermediate the plurality of orbiting wheels, respectively, and the plurality of outer tier orbiting wheels, respectively, each outer tier planetary wheel having a peripheral edge that includes a plurality of teeth.

3. The display assembly as in claim 1, further comprising an article positioned atop an upper side wall of a respective orbiting wheel.

4. The display assembly as in claim 3, wherein said article is taken from a group that includes a mug, an artifact, or a food item.

5. The display assembly as in claim 2, wherein a rotational force applied to said lower display portion is communicated to said upper display portion via said plurality of support rods.

6. The display assembly as in claim 3, wherein each said orbiting wheel is pivotally coupled to said upper surface of said lower display portion such that a rotational movement of said lower display portion causes a complementary rotational movement of said plurality of orbiting wheels, respectively.

7. The display assembly as in claim 4, wherein each said planetary wheel is operatively engaged with a respective orbiting wheel such that a rotational movement of said respective orbiting wheel causes an opposite rotational movement a correspondingly engaged planetary wheel.

8. The display assembly as in claim 3, wherein said lower portion drive wheel is fixedly attached to said shaft so as to be unmovable when said lower display portion is rotated.

9. The display assembly as in claim 2, further comprising a plurality of hooks coupled to said lower surface of said lower display portion said plurality of hooks being spaced apart and configured to hold and suspend a drinking article.

10. A multi-wheel rotational display assembly, comprising:

a base member having an unmovable configuration and that includes a Lazy-Susan bearing and a flange;

a shaft that includes a first end fixedly coupled to said flange, said shaft extending upwardly from said flange and having a linear configuration defining an imaginary longitudinal axis;

a lower display portion having a generally circular and planar configuration that defines a horizontal plane and that includes opposed upper and lower surfaces and a peripheral edge that includes a plurality of teeth, said lower display portion being rotatably coupled atop said Lazy-Susan bearing;

a lower portion drive wheel fixedly coupled to said shaft and positioned in said horizontal plane of said lower display portion so as to be unrotatable, said lower portion drive wheel including a peripheral edge having a first predetermined number of teeth and having a circular configuration defining a first diameter;

an upper display portion upwardly displaced from and parallel to said lower display portion and having a generally circular and planar configuration that defines a horizontal plane and includes opposed upper and lower surfaces and a peripheral edge that includes a plurality of teeth, said lower display portion and said upper display portion each defining an axial aperture through which said shaft freely extends; and a plurality of support rods, each support rod having an elongate and linear configuration that includes a first end coupled to said lower display portion and an upper end coupled to said upper display portion such that said upper display portion is supported by respective support rods, an orbiting wheel assembly having a plurality of orbiting wheels each being displaced from an adjacent orbiting wheel and being displaced a predetermined distance from said peripheral edge of said drive wheel, said plurality of orbiting wheels each including a peripheral edge having a second predetermined number of teeth and having a circular configuration defining a second diameter;

wherein said second predetermined number of teeth is equal to said first predetermined number of teeth;

a planetary wheel assembly having a plurality of planetary wheels each being displaced from an adjacent planetary wheel and being situated intermediate a corresponding orbiting wheel and said lower portion drive wheel, said plurality of planetary wheels each including a peripheral edge having a third predetermined number of teeth and having a circular configuration defining a third diameter;

wherein respective teeth of said each planetary wheel are operatively and simultaneously engaged with a respective tooth of said lower portion drive wheel and with a respective tooth of a respective orbiting wheel.

11. The display assembly as in claim 10, further comprising an article positioned atop an upper side wall of a respective orbiting wheel.

12. The display assembly as in claim 11, wherein said article is taken from a group that includes a mug, an artifact, or a food item.

13. The display assembly as in claim 12, wherein a rotational force applied to said peripheral edge of said lower display portion is communicated to said upper display portion via said plurality of support rods.

14. The display assembly as in claim 13, wherein each said orbiting wheel is pivotally coupled to said upper surface of said lower display portion such that a rotational movement of said lower display portion causes a complementary rotational movement of said plurality of orbiting wheels, respectively.

15. The display assembly as in claim 13, wherein each said planetary wheel is operatively engaged with a respective orbiting wheel such that a rotational movement of said respective orbiting wheel causes an opposite rotational movement of a respective planetary wheel.

16. The display assembly as in claim 10, wherein said lower portion drive wheel is fixedly attached to said shaft so as to be unmovable when said lower display portion is rotated.

17. The display assembly as in claim 16, further comprising a plurality of hooks coupled to said lower surface of said lower display portion said plurality of hooks being spaced apart and configured to hold and suspend a drinking article.

* * * * *